US011920417B2

(12) United States Patent
Crow et al.

(10) Patent No.: US 11,920,417 B2
(45) Date of Patent: Mar. 5, 2024

(54) SETTING TOOL FOR A SUBTERRANEAN ADAPTIVE SUPPORT DELIVERY TOOL WITH ACTUATING PISTON SPEED REGULATION FEATURE

(71) Applicant: CITADEL CASING SOLUTIONS, LLC, Houston, TX (US)

(72) Inventors: Stephen L. Crow, Humble, TX (US); Geoffrey Andrew Patton, Houston, TX (US)

( * ) Notice: Subject to any disclaimer, the term of this patent is extended or adjusted under 35 U.S.C. 154(b) by 0 days.

(21) Appl. No.: 17/542,064

(22) Filed: Dec. 3, 2021

(65) Prior Publication Data

US 2023/0175333 A1 Jun. 8, 2023

(51) Int. Cl.
*E21B 23/06* (2006.01)
*E21B 23/04* (2006.01)

(52) U.S. Cl.
CPC ..... *E21B 23/065* (2013.01); *E21B 23/0412* (2020.05); *E21B 23/0414* (2020.05); *E21B 23/042* (2020.05)

(58) Field of Classification Search
CPC . E21B 23/0412; E21B 23/0414; E21B 23/042
See application file for complete search history.

(56) References Cited

U.S. PATENT DOCUMENTS 2,618,343 A * 11/1952 Conrad ..... E21B 23/065 166/123
2,670,797 A 3/1954 Armentrout
2,701,614 A 2/1955 Ragan et al.
3,250,331 A 5/1966 Boyle
4,480,688 A 11/1984 Rundell et al.
4,872,710 A 10/1989 Konecny et al.
4,911,237 A 3/1990 Melenyzer
5,024,270 A 6/1991 Bostick
8,109,333 B2 2/2012 Yee
9,482,071 B2 * 11/2016 Carrejo ..... F16K 25/005
9,556,704 B2 1/2017 Naedler et al.
9,732,566 B2 8/2017 Mejia et al.
9,810,035 B1 11/2017 Carr et al.
9,828,833 B2 11/2017 Hofman et al.
(Continued)

FOREIGN PATENT DOCUMENTS

WO 2015084479 A1 6/2015
WO 2016049771 A1 4/2016

*Primary Examiner* — Jonathan Malikasim
(74) *Attorney, Agent, or Firm* — Avek IP, LLC

(57) ABSTRACT

An assembly of a setting tool in combination with a delivery tool for an adaptive support allows delivery of the adaptive support in a condition where it stores potential energy. Relative movement between a mandrel and a surrounding sleeve allows release of the adaptive support at a desired subterranean location. The relative movement to release the adaptive support comes from a setting tool that has a setting sleeve and a supporting connection to the mandrel of the delivery tool. The setting sleeve, when triggered to move by preferably an explosive charge, engages a piston rod assembly supported by the delivery tool mandrel for tandem movement to a mandrel travel stop. The tandem movement is regulated, preferably in the delivery tool, with regulation of fluid flow through a restriction to eliminate component failure due to high impact loads when the travel stop is engaged.

11 Claims, 4 Drawing Sheets

(56) References Cited

U.S. PATENT DOCUMENTS

| | | | | |
|---|---|---|---|---|
| 10,273,769 | B2 * | 4/2019 | Crow | E21B 33/1208 |
| 10,287,365 | B2 | 5/2019 | Cheung et al. | |
| 10,287,835 | B2 | 5/2019 | Crow et al. | |
| 10,329,862 | B2 | 6/2019 | Crow et al. | |
| 10,808,492 | B2 * | 10/2020 | Hern | E21B 23/01 |
| 10,927,634 | B2 * | 2/2021 | Crow | E21B 34/142 |
| 11,111,747 | B2 | 9/2021 | Crow | |
| 11,408,237 | B2 * | 8/2022 | Norrid | E21B 33/12 |
| 11,441,374 | B2 * | 9/2022 | Xu | E21B 23/065 |
| 2004/0175229 | A1 * | 9/2004 | Balsells | H01R 13/17 403/345 |
| 2007/0272420 | A1 | 11/2007 | Reimert et al. | |
| 2009/0159293 | A1 | 6/2009 | Jones et al. | |
| 2012/0012771 | A1 | 1/2012 | Korkmaz et al. | |
| 2012/0067583 | A1 | 3/2012 | Zimmerman et al. | |
| 2012/0168178 | A1 | 7/2012 | Eriksen et al. | |
| 2012/0305236 | A1 * | 12/2012 | Gouthaman | E21B 33/1285 166/118 |
| 2013/0319669 | A1 | 12/2013 | Dupree et al. | |
| 2014/0060813 | A1 | 3/2014 | Naedler et al. | |
| 2015/0027780 | A1 | 1/2015 | Hern et al. | |
| 2015/0101823 | A1 | 4/2015 | Carrejo et al. | |
| 2015/0247375 | A1 | 9/2015 | Stout | |
| 2016/0160620 | A1 | 6/2016 | Al-Gouhi | |
| 2016/0186511 | A1 | 6/2016 | Coronado et al. | |
| 2016/0312555 | A1 | 10/2016 | Xu et al. | |
| 2017/0107781 | A1 * | 4/2017 | Kitzman | E21B 33/134 |
| 2017/0226837 | A1 | 8/2017 | Kumar et al. | |
| 2018/0080298 | A1 | 3/2018 | Covalt et al. | |
| 2020/0199958 | A1 * | 6/2020 | Crow | E21B 34/14 |

* cited by examiner

SETTING TOOL FOR A SUBTERRANEAN ADAPTIVE SUPPORT DELIVERY TOOL WITH ACTUATING PISTON SPEED REGULATION FEATURE

FIELD OF THE INVENTION

The field of the invention is actuation tools for subterranean use and more particularly power charge actuation tools with a deceleration feature for the actuating piston.

BACKGROUND OF THE INVENTION

Certain subterranean operations require sequential isolation of zones so that the isolated portion of the formation can be pressure treated to create fractures and subsequently to prop open the fractures after the fractures are created with applied pressure. One way this has been done is to assemble seats into the tool string so that objects can be sequentially dropped as each zone is treated in a bottom zone to top zone sequence. A downside of this approach is that the placement of the seats has to be determined as the string is made up and run into the hole. Formation conditions that are later determined after all the seats are in position may reveal that the positioning of the seats does not optimally coincide with the discrete zones to be isolated and treated.

More recently seats that can be delivered with a delivery tool have been developed as well an associated delivery tool so that supports for isolation devices can be located after the string is assembled and run in the hole. The supports rely on stored potential energy that the delivery tool captures until a release sleeve frees the support from the delivery tool and the dimension of the support increases until contact with the surrounding tubular is achieved. This contact can be abutting or penetration against the surrounding tubular. The engagement of the seat with the surrounding tubular also releases the support from the delivery tool. The delivery tool is designed to create relative movement when powered to actuate. In one embodiment the actuating force during such relative movement is initiated by an explosive charge. U.S. Ser. No. 10/273,769 describes such a running tool. U.S. Ser. No. 10/329,362 and U.S. Ser. No. 10/287,365 describe the adaptive support that is positioned in a tubular with a release of stored potential energy by actuation of the running tool. U.S. Pat. No. 11,111,747 illustrates using a power charge to build pressure and create relative movement that allows the running tool to release the adaptive support for fixation in the surrounding tubular. The contents of these four patents is incorporated by reference herein as though fully set forth.

One potential issue when using the above described equipment is that the force generated by the shifting sleeve on the setting tool can be so high due to the rapid acceleration to impact on the assembly of parts that creates relative movement that releases the adaptive seat can be so high that components in the setting tool or the delivery tool for the adaptive support experience failure in compressive force applied when accelerating parts make impact with stationary parts and, in turn, accelerate other parts to his a travel stop that is held fixed by the setting tool.

This issue is addressed by regulating the rate of flow of well or other fluid that needs to flow into an enlarging void as the piston rod moves to release the adaptive support. Although the piston is referred to as having a rod shape, it can have other shapes and can be solid or tubular and preferably round but other shapes are also contemplated. Conversely, the rate of fluid flow from a decreasing volume due to piston rod movement can also have the same decelerating effect on the parts to reduce applied stress as the assembly of accelerated parts hits a supported surface that acts as a travel stop. In a similar manner as the first example, the failure of parts under a spiking load is avoided as the impact with the piston rod is reduced as the piston rod is initially accelerated and the peak stress as the assembly of accelerated parts hits a fixed travel stop. Either flow in or out of a volume of the tool can regulate the transmitted force applied to the piston rod as it is accelerated to the point of impact against a fixed travel stop. In another alternative fluid can be isolated within the release tool to avoid contaminants found in well fluids such that the relative movement that releases the support for tubular wall contact results in shifting fluid through a restriction or an orifice between two or more isolated compartments, which results in a stress reduction when the piston rod hits a travel stop and the adaptable support is released for contact against the surrounding tubular wall. These and other aspects of the present invention will be more readily understood by those skilled in the art from a review of the description of the preferred embodiment while recognizing that the full scope of the invention is to be determined from the scope of the appended claims.

SUMMARY OF THE INVENTION

An assembly of a setting tool in combination with a delivery tool for an adaptive support allows delivery of the adaptive support in a condition where it stores potential energy. Relative movement between a mandrel and a surrounding sleeve allows release of the adaptive support at a desired subterranean location. The relative movement to release the adaptive support comes from a setting tool that has a setting sleeve and a supporting connection to the mandrel of the delivery tool. The setting sleeve, when triggered to move by preferably an explosive charge, engages a piston rod assembly supported by the delivery tool mandrel for tandem movement to a mandrel travel stop. The tandem movement is regulated, preferably in the delivery tool, with regulation of fluid flow through a restriction to eliminate component failure due to high impact loads when the travel stop is engaged.

DETAILED DESCRIPTION OF THE PREFERRED EMBODIMENT

Figure 1:
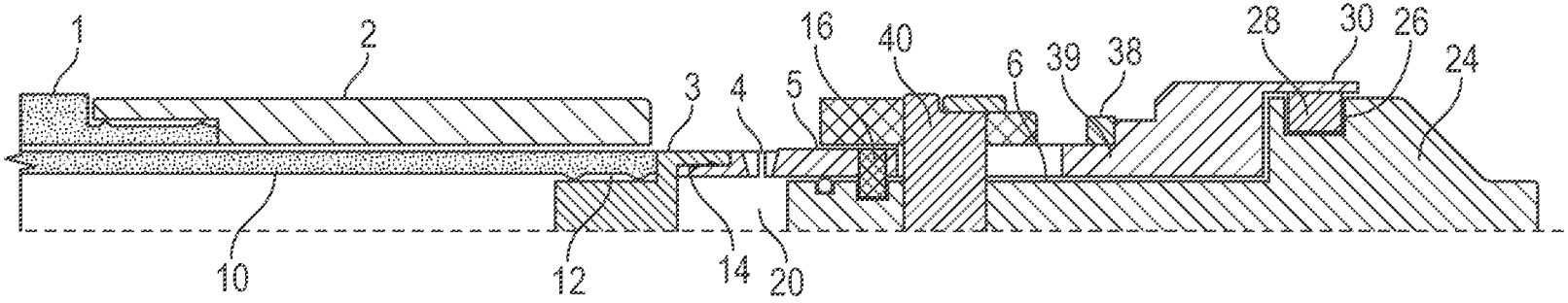
FIG. 1 is a section view of the assembly in the run in position.
Figure 2:
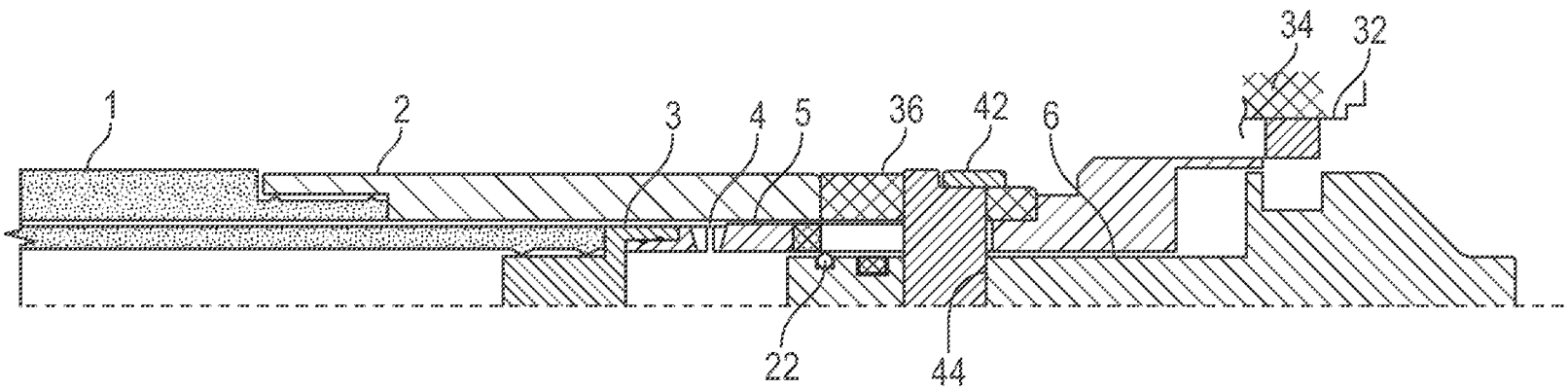
FIG. 2 is the view of FIG. 1 in the actuated position to release the adaptive support.
Figure 3:
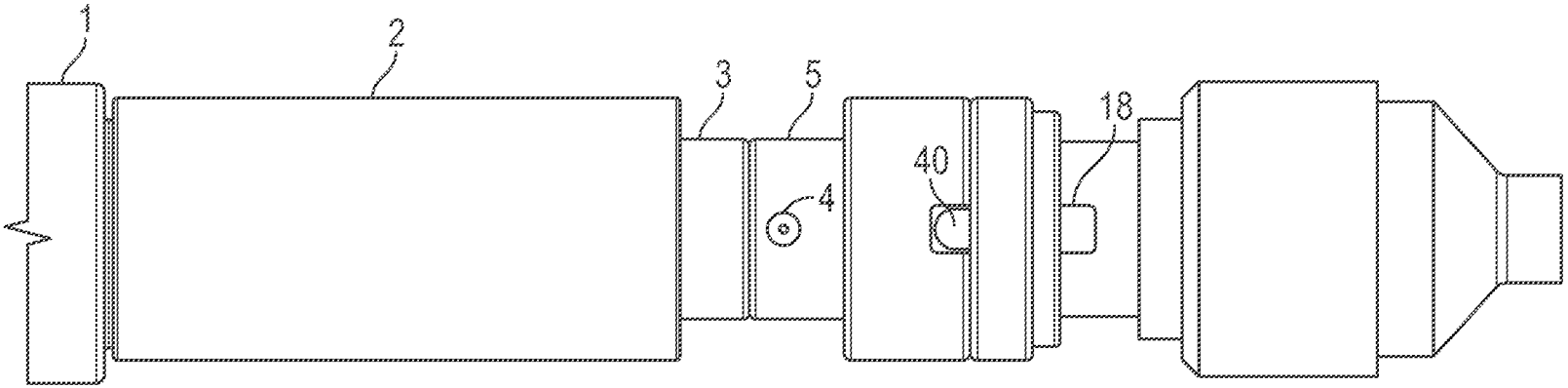
FIG. 3 is an external view showing the connection of the piston rod assembly to the mandrel of the delivery tool.

Referring to FIG. 1 a setting tool 1 that comprises a setting tool mandrel 10 that is secured to delivery tool mandrel 5 at thread 12. Thread 12 is on crossover 3 with thread 14 engaging the delivery tool mandrel 5. Shear pin or pins or a breakable member 16 initially retain piston rod assembly 6 to the delivery tool mandrel 5. Mandrel 5 has a slot 18 which permits the piston rod assembly 6 to move relatively to mandrel 5 in an axial direction once the shear pin or pins 16 are sheared. Chamber 20 is defined internally to mandrel 5 and crossover 3 as well as piston rod assembly 5. Comparing FIGS. 1 and 2 the volume of chamber 20 changes between the FIGS. 1 and 2 positions. A seal 22 initially seals between the piston rod assembly 6 and the delivery tool mandrel 5 and can optionally be undermined to no longer seal in the FIG. 2 position. When the piston rod assembly 6 moves, chamber 20 volume enlarges to draw well fluid through orifice 4. In this manner the acceleration of the piston rod assembly is regulated hydraulically. Piston rod assembly 6 comprises piston rod 24 that has an external recess 26 to house an adaptive seat 28 in the FIG. 1 position due to overlay of mandrel end 30 over the adaptive seat 28. When mandrel end 30 is retracted from an overlaying position in FIG. 1 to a retracted position in FIG. 2, the stored potential energy in adaptive seat 28 is release and it is allowed to enlarge to make contact with the surrounding tubular 32 for support that is abutting or/and penetrating. The adaptive seat 28 is then in the position to accept an object to occlude the passage in the surrounding tubular 32 so that pressure from above can be directed into the desired portion of the formation 34 that surrounds the tubular 32. The piston rod assembly 6 comprises a ring 36 that surrounds the delivery tool mandrel 5 and is movable axially relatively to the delivery tool mandrel 5 until contact is made with surface 38 at which point the relative movement ends. Alternatively or additionally, a resilient ring or crushable ring 39 can be deployed against surface 38 to reduce impact stress when the adaptive seat 28 is released in the FIG. 3 position. In that manner, the deceleration of the piston rod assembly 6 is controlled mechanically. Guide tab 40 passes through an opening in ring 36 and through slot 18. Retaining ring 42 holds guide tab 40 to ring 36. Guide tab 40 passes through a transverse opening 44 in piston rod 24 such that ring 36 moves in tandem with piston rod 24 with no relative rotation with respect to delivery tool mandrel 5. Relative axial movement between the delivery tool mandrel 5 and the piston rod assembly 6 is enabled until ring 36 engages surface 38 as shown in FIG. 2.

Actuation of the setting tool 1 preferably by setting off an explosive charge that is not shown accelerates shifting sleeve 2 into ring 36. That impact with delivery tool mandrel 6 retained by setting tool mandrel 10 breaks shear pin 16 and moves piston rod 24 to release the potential energy in the adaptive support 28 allowing the adaptive support 28 to engage the surrounding tubular 32. As such movement occurs, the volume of chamber 20 has to enlarge to permit piston rod 24 to move. Fluid has to come into chamber 20 and it does so through orifice 4. Orifice 4 is sized to control the force of ultimate impact between ring 36 and surface 38 by virtue of speed regulation of relative component movement between the delivery tool mandrel 5 and the piston rod assembly 6. Until such impact the moving parts are free to accelerate as shear pin 16 is sheared. Without the deceleration effect of orifice 4 the final impact can be so severe as to distort or fracture parts such as setting sleeve 2 or ring 36 which could make removal of the tool problematic and in extreme cases require a millout.

Figure 4:
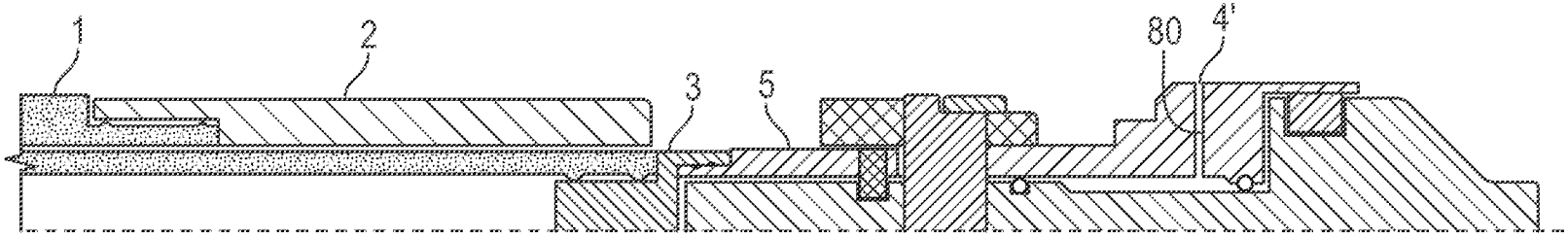
FIG. 4 is an alternative embodiment to the design of FIG. 1 shown in the run in position.
Figure 5:
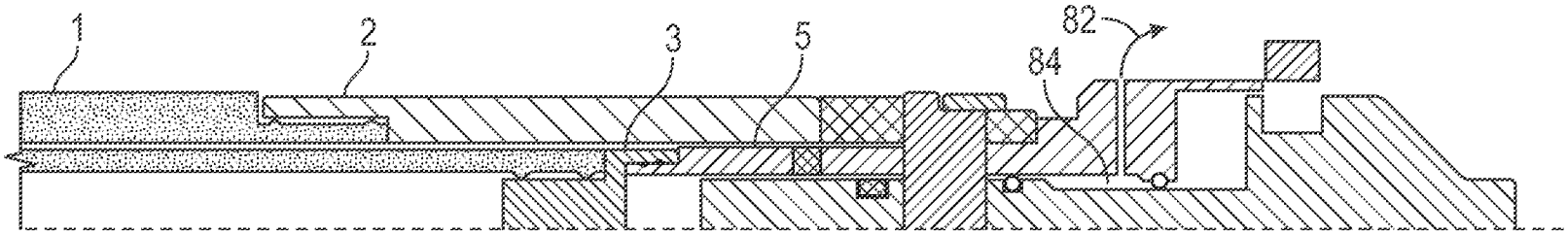
FIG. 5 is the view of FIG. 4 in the actuated position to release the adaptive support.

While the above described preferred embodiment features sucking ire well fluid to accomplish deceleration as the volume of chamber 20 enlarges, the compartment that changes volume in tool can be configured to decrease in volume, as shown in FIGS. 4 and 5 rather than increase forcing well fluid out of the tool through orifice 4'. In this configuration there can be a rupture disc 80 on the orifice 4' to keep well fluids out until the movement starts at which point the expelled well fluid would break the rupture disc to allow fluid exit as indicated by arrow 82. In this manner a clean well fluid in the Chamber 84 that decreases in volume can be expelled. Doing it this way keeps contaminants in the well fluid from being in the changing volume chamber which may create clogging issues with orifice 4.

Figure 6:
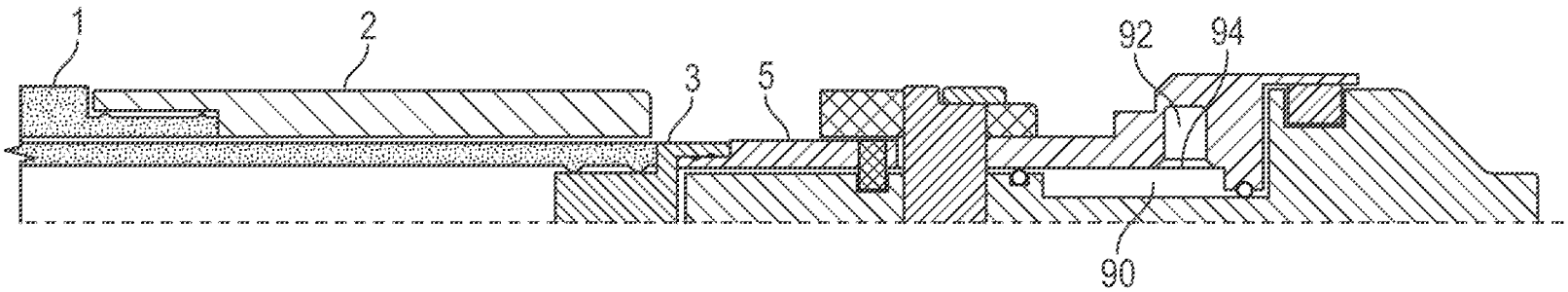
FIG. 6 is an alternative embodiment to the design of FIG. 1 shown in the run in position.
Figure 7:
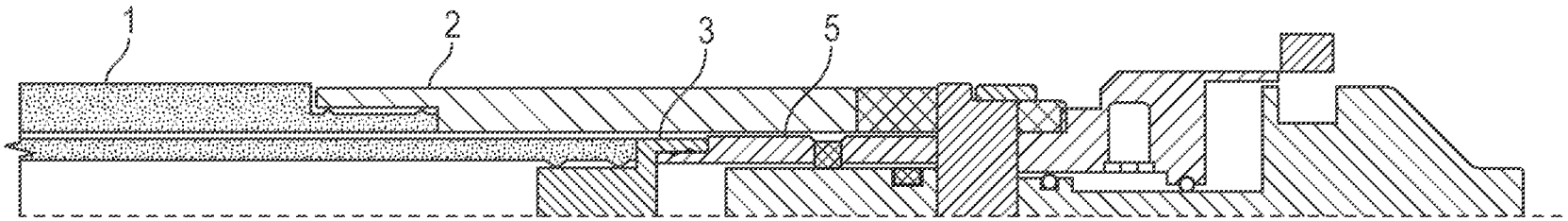
FIG. 7 is the view of FIG. 6 in the actuated position to release the adaptive support.

In another variation, shown in FIGS. 6 and 7, there can be multiple chambers 90 and 92 with a restriction 94 in between. One chamber is initially fluid filled and the other has fluid space to accept displaced fluid through the restriction 94. Clean fluid can be used in the tool that is isolated completely from well fluids to avoid issues with well fluid contaminants fouling the restriction 94. Restriction 94 can be a fixed opening or a passage with a breakable member such as a rupture disc or combinations thereof or equivalent structures to regulate fluid flow that has the effect of controlling component acceleration or deceleration. There may be tradeoffs in the alternative designs in the form of additional seals and seal grooves whereas chamber 20 is functional with a single seal and associated seal groove.

Another approach in addition to fluid flow restriction or in addition to it is to use a resilient ring 39 adjacent surface 38 to absorb or dissipate some of the impact loading. Another variation is a crushable ring against surface 38 or a spring that can be compressed at that location. The intent is to keep the design simple and therefore economical while addressing the high impact loads that setting off different setting tools with a power charge can encompass. Using a setting tool that can be run into position quickly preferably on wireline or slickline in combination with a power charge is the preferred method of conveyance. Those skilled in the art will appreciate that different sized setting tools will be used with matching size delivery tools depending on the tubular 32 size. The orifice 4 is preferably mounted with a threaded connection for easy replacement when reconfiguring the delivery tool for additional runs for placement of multiple adaptive supports 28 in spaced locations in the tubular 32. The illustrated preferred design actuates the piston rod 24 from within the delivery tool mandrel 5 thus allowing placement of the adaptive support 28 in groove 26 with mandrel end 30 overlaying the adaptive support 28 to hold it in a compressed dimension with stored potential energy so that in the FIG. 2 position it can be sprung out to gain supporting contact against tubular 32.

The above description is illustrative of the preferred embodiment and many modifications may be made by those skilled in the art without departing from the invention whose scope is to be determined from the literal and equivalent scope of the claims below:

We claim:

1. An assembly for subterranean use, comprising:

a delivery tool releasably retaining stored potential energy in an adaptive support mounted thereto such that upon speed regulated relative component movement in said delivery tool said adaptive support is released from said delivery tool to find support in a surrounding tubular, said adaptive support accepting an object thereon for selective occlusion of a passage in said tubular for pressure treatment of a surrounding formation traversed by said tubular, and a setting tool selectively initiating said speed regulated relative component movement, wherein:

said speed regulated relative component movement further comprises a changing volume chamber having an opening sized to control flow into or out of said chamber, said chamber is defined on said delivery tool between a mandrel held stationary by said setting tool and a piston assembly slidably mounted substantially within said mandrel, and said piston assembly comprises an extending portion that extends through an opening in said surrounding mandrel to allow a setting sleeve on said setting tool to impact said extending portion of said piston assembly.

2. The assembly of claim 1, wherein:

said flow comprises fluids present within said tubular.

3. The assembly of claim 2, wherein:

said flow enters said chamber as the volume of said chamber increases.

4. The assembly of claim 1, wherein:

said mandrel further comprises a stop shoulder defining the limit of axial travel of said extending portion, said opening comprising an elongated slot limiting movement of said extending portion to an axial direction.

5. The assembly of claim 1, wherein:

said opening comprises a removably mounted orifice.

6. The assembly of claim 1, wherein:

said speed regulated relative component movement is accomplished at least in part by a resilient ring located on a stop surface on a mandrel of said delivery tool.

7. The assembly of claim 1, wherein:

said speed regulated relative component movement is accomplished at least in part by a crushable member located on a stop surface on a mandrel of said delivery tool.

8. The assembly of claim 1, wherein:

the acceleration of a speed regulated relatively moving component is accomplished hydraulically.

9. The assembly of claim 1, wherein:

the deceleration of a speed regulated relatively moving component is accomplished mechanically.

10. The assembly of claim 1, wherein:

said changing volume chamber comprises an initial seal between said mandrel and said piston assembly, said initial seal undermined by said relative component movement.

11. The assembly of claim 1, wherein:

said mandrel and said piston assembly are initially retained against said relative component movement with at least one shear pin or a breakable member.

* * * * *